US005298697A

United States Patent [19]

Suzuki et al.

[11] Patent Number: 5,298,697

[45] Date of Patent: Mar. 29, 1994

[54] APPARATUS AND METHODS FOR DETECTING NUMBER OF PEOPLE WAITING IN AN ELEVATOR HALL USING PLURAL IMAGE PROCESSING MEANS WITH OVERLAPPING FIELDS OF VIEW

[75] Inventors: Masato Suzuki, Ibaraki; Hiromi Inaba, Katsuta; Kiyoshi Nakamura, Katsuta; Naofumi Nakata, Katsuta; Hiroaki Yamani, Katsuta; Naoto Oonuma, Hitachi, all of Japan

[73] Assignee: Hitachi, Ltd., Tokyo, Japan

[21] Appl. No.: 948,255

[22] Filed: Sep. 21, 1992

[30] Foreign Application Priority Data

Sep. 19, 1991 [JP] Japan ..... 3-266951

[51] Int. Cl.[5] ..... B66B 1/20

[52] U.S. Cl. ..... 187/131; 187/132; 348/135; 348/159; 382/41

[58] Field of Search ..... 187/131, 132; 358/136, 358/204; 382/41, 42

[56] References Cited

U.S. PATENT DOCUMENTS

| | | | |
|---|---|---|---|
| 4,112,419 | 9/1978 | Kinoshita et al. | 340/560 |
| 4,393,410 | 7/1983 | Ridge et al. | 358/285 |
| 4,555,724 | 11/1985 | Enriquez | 358/93 |
| 4,797,942 | 1/1989 | Burt | 382/41 |
| 5,182,776 | 1/1993 | Suzuki et al. | 382/14 |

FOREIGN PATENT DOCUMENTS 2-249877 10/1990 Japan .

*Primary Examiner*—Robert Skudy
*Assistant Examiner*—Robert Nappi
*Attorney, Agent, or Firm*—Antonelli, Terry, Stout & Kraus

[57] ABSTRACT

An apparatus for detecting people waiting for an elevator. A detecting unit detects the number of people waiting on the basis of an image from an image pickup unit and delivers that number to a corresponding second people waiting detecting unit. The apparatus includes a unit which generates a coefficient depending on a percentage of overlap of the field of view of a reference image pickup unit, which is one of several image pickup units, with the field of view of a different image pickup unit on the basis of data on the allocation of an elevator, and calculates the number of waiting people in the overall hall from the respective numbers of waiting people output from the plurality of image pickup units and those coefficients. The coefficient generating unit generates a maximum coefficient for the reference image pickup unit and a smaller coefficient for any remaining image pickup unit based on the of overlap of the field of view of the respective image pickup units. Thus, even if the fields of view of the plurality of image pickup units overlap, an accurate number of people waiting in the elevator hall, and free from an error in detection, is detected.

11 Claims, 6 Drawing Sheets

APPARATUS AND METHODS FOR DETECTING NUMBER OF PEOPLE WAITING IN AN ELEVATOR HALL USING PLURAL IMAGE PROCESSING MEANS WITH OVERLAPPING FIELDS OF VIEW

BACKGROUND OF THE INVENTION

The present invention relates to apparatus and methods for detecting people waiting in an elevator hall, and more particularly to such apparatus and method which reduces possible errors in the detection of the number of people waiting which errors occur due to an overlap of fields of view of a plurality of image pickup units.

A conventional technique directed to a device which detects the number of people waiting for elevators in an elevator hall, using a plurality of image pickup units, is disclosed, for example, in Japanese Patent Publication JP-A 2-249877.

In this technique, two kinds of image processing means are provided to pick up the image of the elevator hall without dead angles to detect the number of waiting people. Usually, an elevator controller controls the operation of the elevator on the basis of the result of such detection.

The conventional technique does not allow for a possible error in the detection occurring due to an overlap of fields of view of a plurality of image pickup units and cannot correctly detect the number of waiting people, disadvantageously.

SUMMARY OF THE INVENTION

It is an object of the present invention to provide an apparatus and method for solving the problems which exist with the conventional techniques and for correctly detecting the number of waiting people in an overall hall, using a plurality of image pickup units, without errors, even if the plurality of image pickup units overlap in field of view.

According to the present invention, the above object is achieved by multiplying the respective numbers of waiting people which are obtained by processing the video signal outputs from the image pickup units by corresponding coefficients, depending on the corresponding percentages of overlap of fields of view of the image pickup units, and adding the respective results obtained. Multiplication of the respective coefficients serves to adjust the corresponding apparent areas of fields of view.

Means are provided for generating coefficients depending on the corresponding percentages of overlap of fields of view of the image pickup units. The means set a maximum coefficient for a reference image pickup unit and a coefficient for each of the remaining image pickup units in such a manner that the latter coefficient is based on the percentage of overlap of the field of view of that remaining image pickup unit with respect to the field of view of the reference image pickup. By multiplying these coefficients and the corresponding individual numbers of waiting people as indicated by the image pickup units, the results of detection by the image pickup units with overlapping of their fields are corrected.

The reference image pickup unit has a field of view directly in front of the elevator assigned to that image pickup unit. The present invention thus reduces the possible error in the detection of the number of waiting people in the overall hall.

DESCRIPTION OF THE PREFERRED EMBODIMENT

An embodiment of a device for detecting people waiting in an elevator hall according to the present invention will be described with respect to the drawings.

Figure 1:
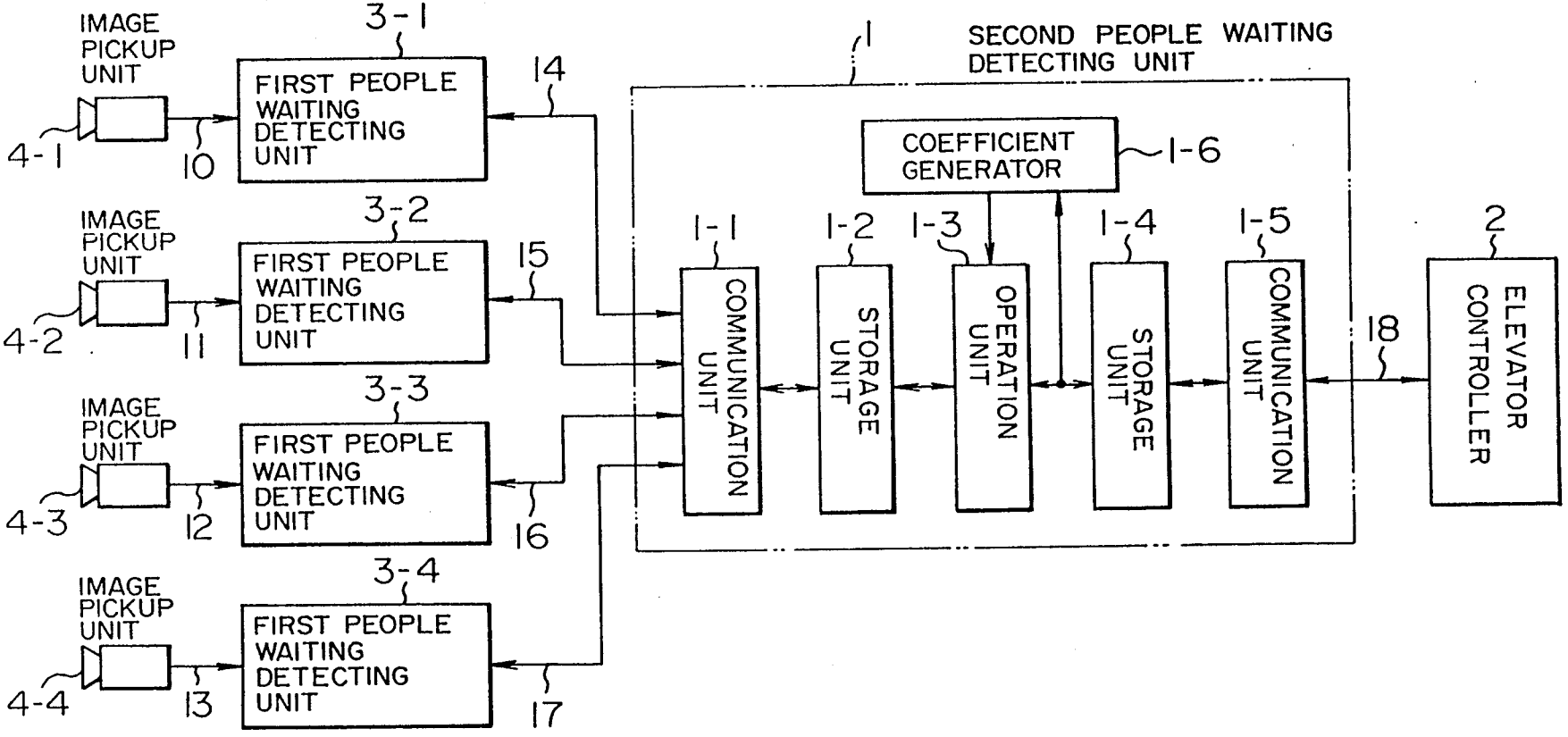
FIG. 1 is a block diagram of a schematic structure of a people waiting detecting device as one embodiment of the present invention.
Figure 2:
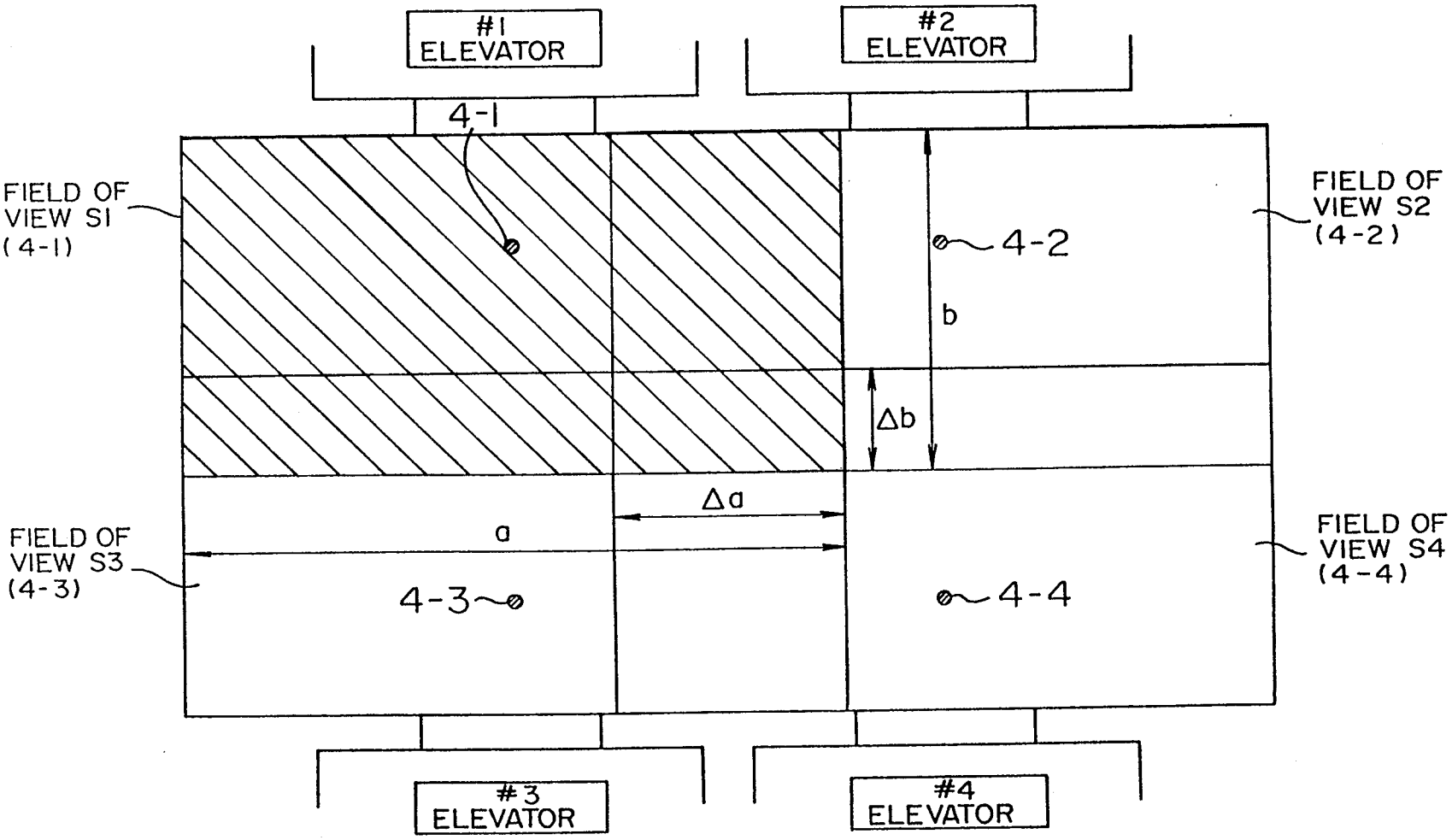
FIG. 2 illustrates an arrangement of image pickup units and a method of calculating the coefficients.

Referring to FIGS. 1 and 2, reference numeral 1 denotes a second waiting people detecting device; 1-1, 1-5, a communication unit; 1-2, 1-4, a storage unit; 1-3, an operation unit; 1-6, a coefficient generator; 2, an elevator controller; 3-1 to 3-4, a first waiting people detecting unit; and 4-1 to 4-4, an image pickup unit.

The embodiment of the present invention shown in FIG. 1 includes, as shown in FIG. 2, a device which detects people waiting in an elevator hall, using four image pickup units 4-1 to 4-4 for corresponding elevators #1–#4. Units 4-1 to 4-4 are provided on the ceiling of the elevator hall in which two elevators face each other and the other two elevators similarly face each other. The optical axis of an optical lens of each image pickup unit is normal to its field of view.

The people waiting detecting device as the embodiment of the present invention shown in FIG. 1 includes the four image pickup units 4-1 to 4-4, first people waiting detecting units 3-1 to 3-4 provided for processing the image signal outputs 10-13 from the corresponding image pickup units, a second people waiting detecting unit 1 connected to the first people waiting detecting units 3-1 to 3-4 through corresponding bilateral lines 14–17 to calculate the number of people waiting in the elevator hall from the corresponding numbers of people waiting and an elevator controller 2 connected through a bidirectional transmission line 18 to the second people waiting detecting unit 1 to control the respective operations of the elevators on the basis of the information on the people waiting.

As shown in FIG. 2, the respective image pickup units 4-1 to 4-4 have fields of view S1–S4 of the same size ($a \times b$). The respective fields of view of the image pickup units overlap in an area of $\Delta a \times \Delta b$.

Figure 3:
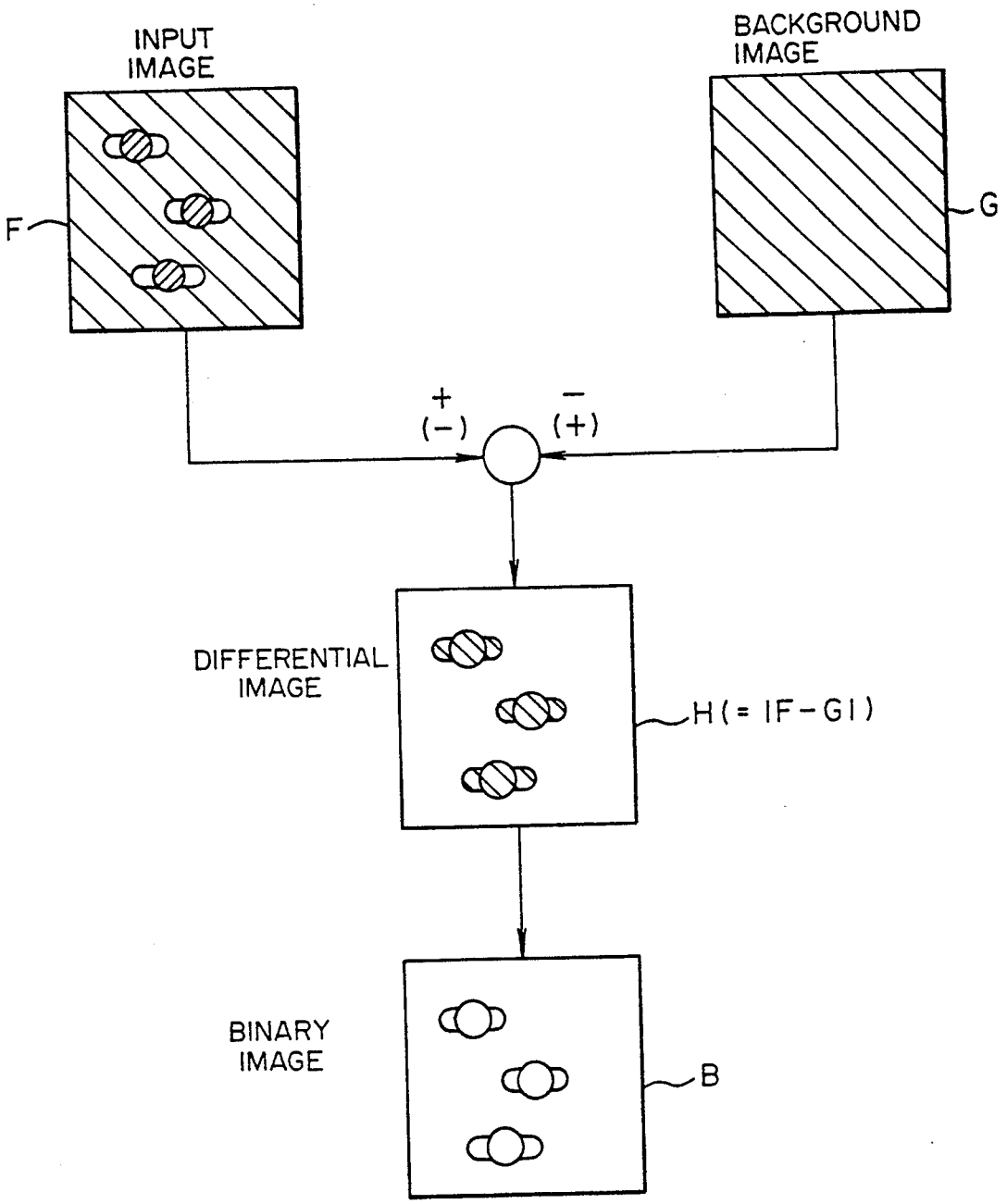
FIG. 3 PRIOR ART
FIG. 3 illustrates the procedures of detecting the number of waiting people.

An illustrative process for processing the image signal outputs 10–13 output by from the image pickup units 4-1 to 4-4 using first people waiting detecting units 3-1 to 3-4 to obtain the respective numbers of people waiting N1–N4 will be described below with reference to FIG. 3.

The first respective people detecting units 3-1 to 3-4 beforehand obtain and store the hall images as a background image G when there are no waiting people. The first people detecting unit 3-1 to 3-4 each obtain the absolute value of the difference between the corresponding background image G and the input image F, obtained when required, to thereby provide a differential image H, and hence the image of waiting people alone by removing the background from the input image. Thereafter, the respective first detecting units 3-1 to 3-4 compare the differential image H with an appropriate threshold to obtain a black and white binary image B, obtains the area Swn of the white portion of the binary image B, calculates from the following equation (1) the value obtained by dividing the area Swn by a reference area per people SO, and outputs the result as the number of people waiting Nn (n is 1–4):

$$Nn = Swn/Swo \text{ where } n = 1\text{–}4 \quad (1)$$

Figure 4:
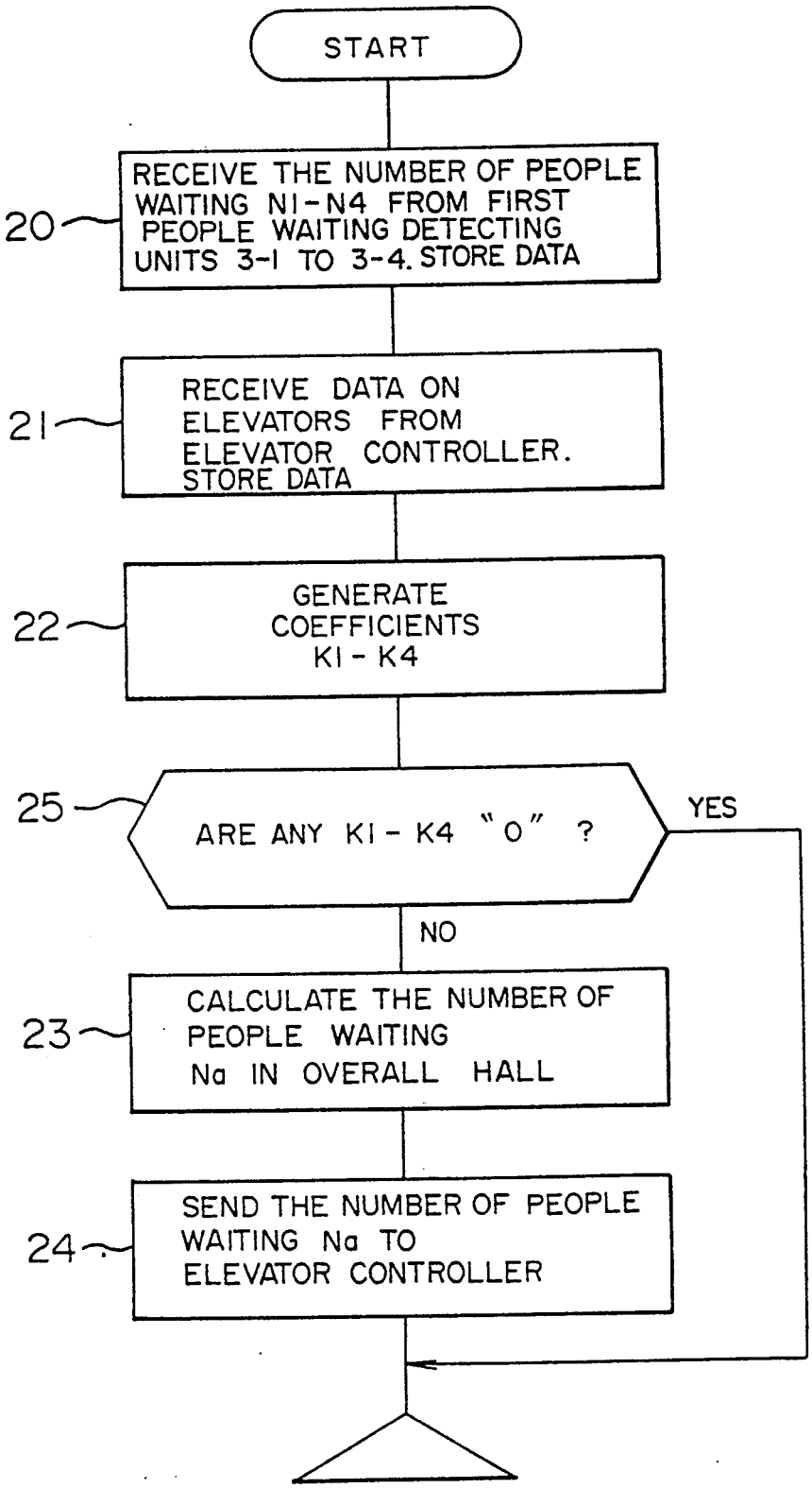
FIG. 4 is a flowchart indicative of the operation of a second people waiting detecting device.

The second people detecting device 1 calculates the number of people in the overall elevator hall on the basis of the respective numbers of people Nn from the first people detecting units 3-1 to 3-4 thus obtained. This processing will be described with reference to the flowchart of FIG. 4.

(1) The second people detecting unit 1 periodically receives data on the respective numbers of people N1–N4 from the first communication unit 1-1 and rearranges and stores that data in the first storage unit 1-2 (step 20).

(2) The second people waiting detecting unit 1 receives information on the elevator transmitted periodically from the elevator controller 2 through a second communication unit 1-5 and rearranges and stores the information in second storage unit 1-4 (step 21).

Figure 5:
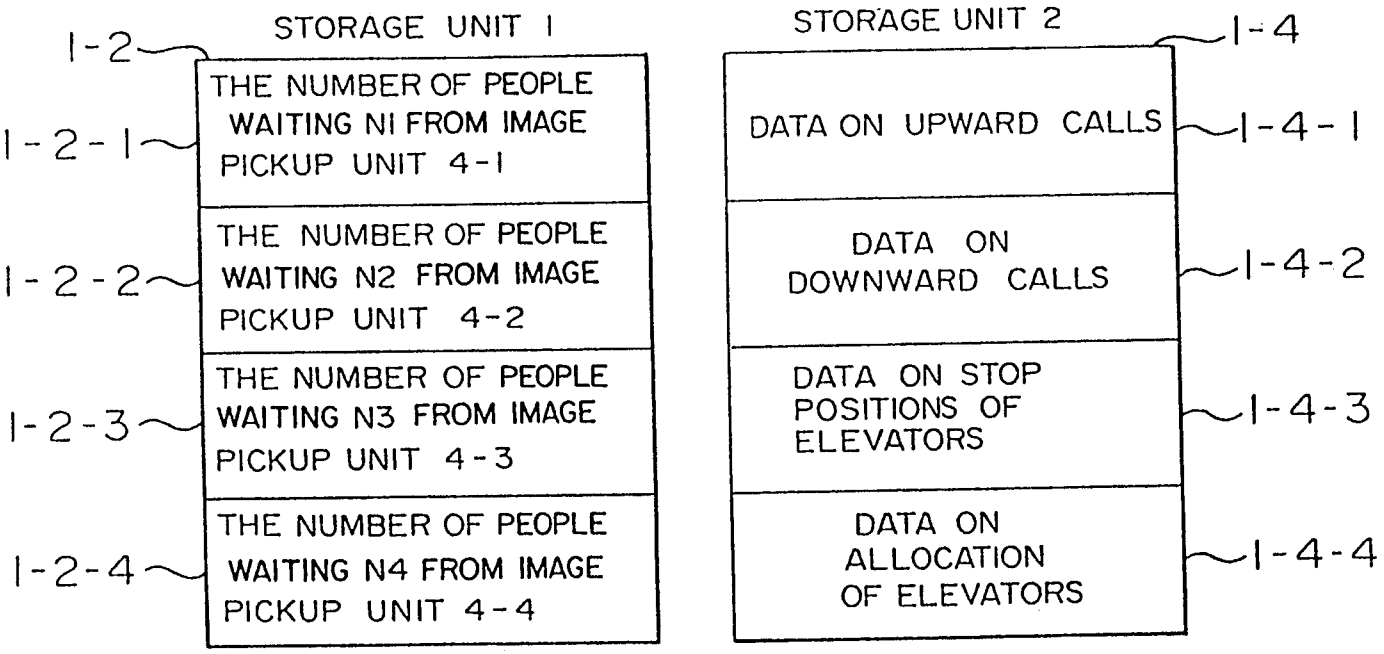
FIG. 5 illustrates the data stored in a storage unit.

The data in these storage units are shown in FIG. 5. The first storage unit 1-2 stores the respective numbers of people waiting N1–N4 (1-2-1 to 1-2-4) corresponding to the image pickup units 4-1 to 4-4 in the order shown. The second storage unit 1-4 stores, in the order shown data on upward calls for an elevator (indicative of the presence/absence of upward calls from each floor) 1-4-1 and data on downward calls for an elevator (indicative of the presence/absence of downward calls from each floor) 1-4-2, data on the elevator stop positions (indicative of which floors the elevators are at rest at) 1-4-3, data on elevator allocation (which elevators are allocated at the respective floors) 1-4-4.

(3) Thereafter, the coefficient generator 1-6 determines coefficients K1–K4 corresponding to the respective image pickup units on the basis of the elevator data stored in the second storage unit 1-4. This processing will be described in more detail later with reference to the flowchart of FIG. 6 (step 22).

(4) If all the coefficient K1–K4 are "0" as the result of the processing at step 22, the result of detection of the people waiting is determined to be unreliable, and the subsequent processing operations are bypassed (step 25).

(5) If no coefficients K1–K4 are "0", the operation unit 1-3 performs the operation for the following equation (2), using the obtained coefficients K1–K4 and the corresponding numbers of people waiting N1–N4:

$$Na = K1 \cdot N1 + K2 \cdot N2 + K3 \cdot N3 + K4 \cdot N4 \quad (2)$$

to calculate the number of people waiting Na in the overall elevator hall and delivers this data to the elevator controller (steps 23, 24).

The processing at step 22 by the coefficient generator 1-6 will be described with reference to the flowchart of FIG. 6.

(1) First, the coefficient generator 1-6 refers to data on the stop positions of the elevators, 1-4-3, to confirm that no elevators are at a stop at the floors where the image pickup units are detecting the people waiting in order to prevent the detection of people getting out of the elevator (step 22-1). In the present invention, detection of the number of people getting out of the elevator and then moving causes an error, so that it is not required.

(2) The generator 1-6 then refers to data on the upward and downward calls 1-4-1, 1-4-2 and confirms whether an elevator is distant by ±one floor or less from the floors where the image pickup units are detecting in order to prevent the detection of people who have gotten out of an elevator which has recently arrived, as at the step 22-1 (step 22-5).

(3) When the elevator is at a stop at the floor where the image pickup unit is detecting at step 22-1, or when the elevator is distant by ±one floor or less from the floor where the image pickup unit is detecting, the coefficient generator 1-6 sets all the coefficients K1–K4 at "0" (step 22-6).

(4) Otherwise, the generator 1-6 refers to data on the allocation of elevators, 1-4-4, to determine whether there is an allocated elevator (step 22-2).

(5) If there is an allocated elevator at step 22-2, the generator 1-6 determines coefficients K1–K4 corresponding to the respective image pickup units 4-1 to 4-4, using as a reference the image pickup unit corresponding to the allocated elevator (step 22-3).

(6) If there are no allocated elevators at step 22-2, the generator 1-6 determines the coefficient K1–K4, using as a reference the image pickup unit detecting the largest one of the numbers of people N1–N4 (step 22-4).

The calculation of coefficients K1–K4 by the processing at steps 22-3, 22-4 will be described with reference to FIG. 2.

FIG. 2 shows the case where the image pickup unit 4-1 is used as a reference and assumes that all the fields of view (the horizontal length is shown by a and the vertical length by b) of the image pickup units 4-1 to 4-4 are the same.

The field of view S1(=a×b) of the image pickup unit 4-1 is shown hatched in FIG. 2. Let the horizontal and vertical lengths of the area where the fields of view overlap be Δa and Δb, respectively. When priorities are given to image pickup units, starting with the particular image pickup unit 4-1, the field of view S2 omitting for the overlapping portions for the image pickup unit 4-2 can be obtained in accordance with the following equation (3):

$$S2 = S1 - (a \cdot \Delta b + b \cdot \Delta a - \Delta a \cdot \Delta b) \quad (3)$$

The fields of view for the image pickup units 4-3, 4-4 can be obtained similarly in accordance with the following equations (4) and (5):

$$S3 = S1 - (a \cdot \Delta b + b \cdot \Delta a - \Delta a \cdot \Delta b) \quad (4)$$

$$S4 = S1 - (a \cdot \Delta a \cdot \Delta b \quad (5)$$

The ratios of the respective fields of view S2–S4, thus obtained, of the image pickup units 4-2 to 4-4 to the field of view S1 of the image pickup unit 4-1 are calculated from equations (6) and (7) and the results are used as coefficients K2–K4 (where K1=1) for the image pickup units 4-2 to 4-4. For example, in the present embodiment, K2=K3=0.56 and K4=0.94.

$$K2=K3=1-(a\cdot\Delta b+\Delta\Delta a\cdot\Delta b/a\cdot b \quad (6)$$

$$K4=1-\Delta a\cdot\Delta b/a\cdot b \quad (7)$$

Figure 6:
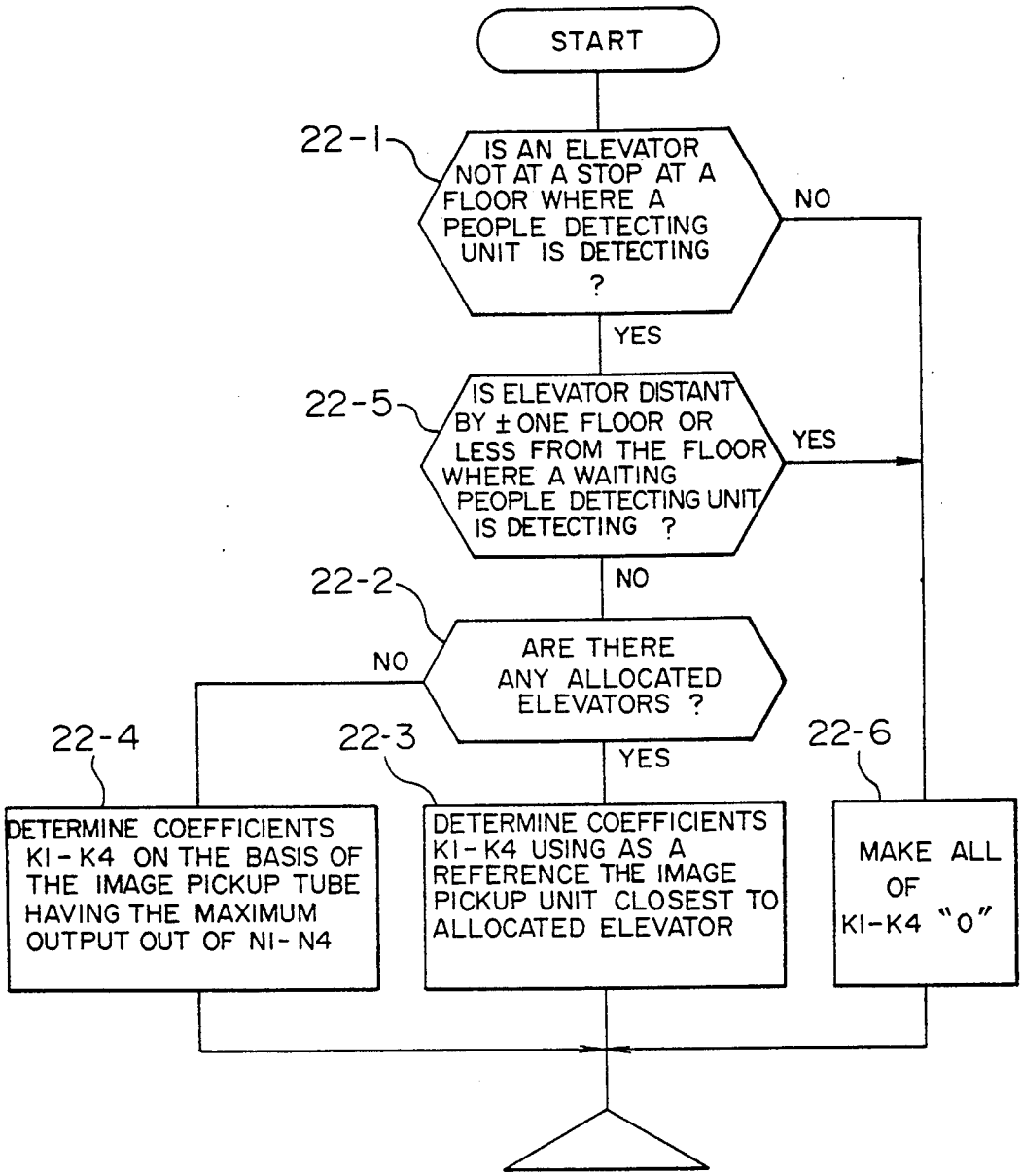
FIG. 6 is a flowchart illustrative of the operation of a coefficient generator.

While the embodiment calculates a respective one of the coefficients K1-K4 each time the processing shown in FIG. 6 takes place (for example, at intervals of 200 ms), for example, by a microcomputer using equations (3)-(7), the present invention may calculate the coefficients K1-K4 beforehand in accordance with equations (3)-(7) when the status of installation of the image pickup units is known, store the coefficients K1-K4 in the form of a table, and cause the coefficient generator 1-6 to only rearrange the coefficients depending on the selected reference image pickup unit.

If there are allocated elevators or there are image pickup units which produce the same output value, in the FIG. 6 flow, the priorities of the image pickup units may be determined in a manner in which younger numbered image pickup units are handled preferentially.

While in the embodiment the coefficient generator 1-6 is illustrated as provided in the second waiting people detecting unit 1, the coefficient generator 1-6 may be provided in the elevator controller 2 having elevator information, in the present invention.

According to the above embodiment, if there is an allocated elevator, the outputs of the people detection units are corrected in accordance with the respective percentages of overlap of their fields of view with respect to the field of view of the image pickup unit corresponding to the allocated elevator having a high probability of presence of waiting people or with respect to the image pickup unit which has an output signal indicative of the maximum number of people even if there is no allocated elevator. Therefore, the number of waiting people closest to the actual number of people in the overall elevator hall is obtained. When there is an allocated elevator, the number of waiting people in the overall elevator can be detected by regarding most of the people as getting into that elevator.

While the embodiment determines the reference image pickup unit, and determines the coefficients for the number of waiting people obtained from other image pickup units in consideration of the percentages of overlap of the fields of view of the said other image pickup units with the field of view of the reference image pickup unit, the present invention may beforehand determine the effective portions of the respective image pickup regions of the image pickup units so as to be the same and so as not to overlap each other.

In this case, for example, according to the example of FIG. 2, the effective area SR of each image pickup unit can be expressed as $$SR=[a-(\Delta a/2)]\times[b-(\Delta b/2)]$$

and the coefficients K1-K4 are:

$$K1=K2=K3=K4=1$$

While the embodiment calculates the number of people waiting in the overall elevator hall in consideration of the overlap portions of the respective image pickup regions of the image pickup units, all the people in the elevator hall are generally not necessarily waiting for the elevator, and the people waiting for the elevator are in the vicinity of that elevator in many cases.

The present invention may determine the coefficients in consideration of such points.

For example, as shown in the example of FIG. 2, if the allocated elevator is elevator #1, one and the coefficient K1 for the people waiting from the image pickup unit 4-1 for the #1 elevator is "1", the coefficients K2-K4 for the numbers of people obtained from other image pickup units may be corrected with an empirically determined ratio of people entering the elevator, or the coefficients allowing for the percentages of the overlap may be corrected with such ratio. For example, in the embodiment (where K1=1, K2=K3=0.56, and K4=0.94), K1=1×0.8=0.8, K2=K3=0.56×0.8=0.448, and K4=0.94×0.8=0.752 with the ratio being 80%.

In this case, the number of people which will enter the allocated elevator can be predicted.

The coefficient generator may be provided either in the second waiting people detecting unit 1, as shown in FIG. 1, or in the elevator controller 2.

As described above, according to the present invention, the result of detection of the image pickup unit which has a large percentage of overlap of its field of view with that of the reference image pickup unit can be corrected to thereby obtain the number of people closest to the actual number of people waiting in the overall elevator hall without errors in the detection.

We claim:

1. An apparatus for controlling operation of an elevator, based on detecting people waiting in an elevator hall, said apparatus comprising:

a plurality of image pickup devices for picking up a plurality of images of the elevator hall, each image pickup device picking up an image of a respective field of view of the elevator hall, the respective fields of view overlapping by a known amounts;

means for processing image signals from the plurality of image pickup devices to detect respective numbers of people waiting in each field of view;

means for generating a set of coefficients based on the amounts of overlap of the fields of view;

means for calculating the number of people waiting in the elevator hall, based on the generated coefficients and the respective detected numbers of people waiting in each field of view; and means for controlling the operation of the elevator based on the number of people waiting.

2. An apparatus according to claim 1, wherein said coefficient generating means generates the coefficients further based upon a predetermined ratio of detected people waiting who enter an elevator.

3. An apparatus according to claim 1, wherein said coefficient generating means generates a reference coefficient for a selected one of said image pickup devices, and generates a coefficient for each of the remaining image pickup devices based upon the percentage of overlap of the respective field of view of said each of the remaining image pickup devices with the field of view of the selected image pickup device.

4. An apparatus according to claim 3, wherein said selected one of said image pickup devices is the image pickup device providing the image signal indicative of the maximum number of people waiting.

5. An apparatus according to claim 1, wherein said coefficient generating means is provided in said people waiting detecting means.

6. An apparatus according to claim 1, wherein said coefficient generating means is provided in said controlling means.

7. A method of controlling an elevator, comprising the steps of:

(a) detecting respective numbers of people waiting in each of a plurality of fields of view in an elevator hall, the respective fields of view overlapping by known amounts;

(b) generating a set of coefficients based on the amounts of overlap of the fields of view;

(c) calculating the number of people waiting in the elevator hall, based on the generated coefficients and the respective detected numbers of people waiting in each field of view; and (d) controlling the operation of the elevator, based on the calculated number of people waiting.

8. A method according to claim 7, wherein step (b) comprises generating a reference coefficient for a selected one of fields of view, and generating a coefficient for each of the remaining fields of view, based upon the percentage of overlap of the respective field of view of said each of the remaining image pickup devices with the field of view of the reference image unit.

9. A method according to claim 8, wherein the selected field of view is directly before an allocated elevator.

10. An apparatus according to claim 3 wherein said selected one of said image pickup devices is the image pickup device closest to an elevator to which said controlling means has allocated service.

11. A method according to claim 8, wherein the selected field of view is the field of view for which the detected respective number of people waiting is a maximum.

* * * * *